US009482120B2

(12) United States Patent
Brune et al.

(10) Patent No.: US 9,482,120 B2
(45) Date of Patent: Nov. 1, 2016

(54) RETENTION DEVICE FOR VALVE ACTUATING MECHANISM

(71) Applicant: GT Technologies, Westland, MI (US)

(72) Inventors: John E. Brune, Stockbridge, MI (US); Ira R. Stoody, Roseville, MI (US)

(73) Assignee: GT Technologies, Westland, MI (US)

( * ) Notice: Subject to any disclaimer, the term of this patent is extended or adjusted under 35 U.S.C. 154(b) by 28 days.

(21) Appl. No.: 14/220,191

(22) Filed: Mar. 20, 2014

(65) Prior Publication Data

US 2014/0283775 A1 Sep. 25, 2014

Related U.S. Application Data

(60) Provisional application No. 61/804,796, filed on Mar. 25, 2013.

(51) Int. Cl.
*F01L 1/18* (2006.01)
*F01L 1/24* (2006.01)

(52) U.S. Cl.
CPC ..... *F01L 1/185* (2013.01); *F01L 1/2405* (2013.01); *F01L 2001/187* (2013.01)

(58) Field of Classification Search
CPC .. F01L 1/185; F01L 1/2405; F01L 2001/187
USPC ..... 123/90.39, 90.45, 90.43, 90.44
See application file for complete search history.

(56) References Cited

U.S. PATENT DOCUMENTS 3,002,507 A 10/1961 Bensinger et al.
3,139,872 A 7/1964 Thompson
3,166,058 A 1/1965 Zink
4,369,740 A 1/1983 Seidl
4,494,729 A 1/1985 Krueger
4,539,953 A 9/1985 Sasaki et al.
4,598,674 A 7/1986 Nono et al.
4,676,203 A 6/1987 Nouno
5,211,143 A 5/1993 Fontichiaro et al.
5,775,280 A 7/1998 Schmidt et al.
6,047,675 A 4/2000 Kunz (Continued)

FOREIGN PATENT DOCUMENTS

DE 3500524 A1 7/1985
DE 10 2005 036 918 A1 2/2007

(Continued)

OTHER PUBLICATIONS

Sep. 18, 2014 European Search Report for European Application No. 14161084.0-1606.
Office Action for European Pat. Application No. EP14 161 084.0 dated Nov. 3, 2015, 5 pages.

*Primary Examiner* — Ching Chang
(74) *Attorney, Agent, or Firm* — Howard and Howard Attorneys PLLC

(57) ABSTRACT

A retention device for a valve actuating mechanism to secure a finger follower and lash adjuster together includes a ring member disposed in a groove of a movable piston of the lash adjuster. The retention device also includes a connecting member having a plurality of legs adapted to engage the finger follower and an intermediate base interconnecting the legs and adapted to be disposed below the ring member and about a portion of the lash adjuster to effect a free movement of the connecting member in all pivoted positions of the finger follower.

18 Claims, 9 Drawing Sheets

(56) References Cited

U.S. PATENT DOCUMENTS

| | | | | |
|---|---|---|---|---|
| 6,460,495 | B1 | 10/2002 | Seitz et al. | |
| 6,491,012 | B2 | 12/2002 | Pryba et al. | |
| 6,543,402 | B2 | 4/2003 | Burns | |
| 6,758,180 | B2 | 7/2004 | Pierik | |
| 7,146,950 | B2 | 12/2006 | Moeck et al. | |
| 7,350,490 | B2 | 4/2008 | Mock et al. | |
| 7,721,695 | B2 | 5/2010 | Moeck et al. | |
| 8,584,640 | B2 * | 11/2013 | Moeck | F01L 1/185 123/90.39 |
| 2012/0260874 | A1 | 10/2012 | Moeck et al. | |

FOREIGN PATENT DOCUMENTS

| | | | |
|---|---|---|---|
| DE | 10 2008 025 034 | A1 | 11/2009 |
| DE | 10 2008 029 293 | A1 | 12/2009 |
| DE | 10 2008 052 280 | A1 | 4/2010 |
| EP | 2 233 704 | A1 | 9/2010 |
| EP | 2 662 541 | A1 | 11/2013 |
| WO | 00/20730 | A1 | 4/2000 |
| WO | 2005/028816 | A1 | 3/2005 |
| WO | 2009/154621 | A1 | 12/2009 |

* cited by examiner

RETENTION DEVICE FOR VALVE ACTUATING MECHANISM

CROSS REFERENCE TO RELATED APPLICATIONS

This application claims the benefit of U.S. provisional patent application entitled "Retention Device for Valve Actuating Mechanism," having Ser. No. 61/804,796, and filed on Mar. 25, 2013.

BACKGROUND OF THE INVENTION

1. Field of the Invention

The present invention relates generally to valve actuating mechanisms for engines and, more particularly, to a retention device for a valve actuating mechanism for an engine.

2. Description of the Related Art

It is known to provide valve actuating mechanisms to open and close valves of an engine such as an internal combustion engine. These valve actuating mechanisms may be of a finger follower type including a finger follower having a pallet or web engaging a stem of the valve and a dome socket engaging a rounded end of a hydraulic lash adjuster supported by a cylinder head of the engine. The dome socket is known to have a dome with a concave recess or socket therein. Typically, a circular opening or orifice is provided in the dome for spraying lubrication fluid from the dome socket into a camshaft compartment for lubricating a cam and cam follower and associated components of the valve actuating mechanism.

It is known to provide a device for securing the finger follower and hydraulic lash adjuster together. For example, U.S. Pat. No. 5,775,280 to Schmidt et al. discloses a securing device for an actuating lever in a valve control mechanism of an internal combustion engine. In this patent, a hydraulic lash adjuster disposed below a spherical end of a finger follower or lever and has an undercut for receiving a connecting element in the form of a sheet metal retention clip so that the finger follower and the hydraulic lash adjuster form a structural unit. The sheet metal retention clip has a thickness which is smaller than the width of the undercut, so that the connecting element does not spring open during pivoting movements of the finger follower but bears firmly against the socket-like portion of the finger follower and thus does not cause an additional increase of friction in the valve drive mechanism. The sheet metal retention clip exhibits a generally U-shaped configuration and is comprised of an arm, which engages a top surface of the finger follower, and a second, bifurcated arm which is received in the undercut. An intermediate portion connects the arms to each other, with the arms additionally formed with retaining lugs for securing the clip in place.

The above-described patented sheet metal retention clip suffers from the disadvantage that this clip always effects a relative movement in relation to the finger follower or the lash adjuster. Another disadvantage is that the constant relative movement occurring between the retention clip and the finger follower and between the retention clip and the lash adjuster subjects the valve actuating mechanism to additional friction, which is undesired. A further disadvantage of the retention clip is that it does not bear firmly against the finger follower in all operating positions of the valve actuating mechanism as a result of the pivoting motion of the finger follower.

Therefore, it is desirable to provide a retention device to secure the actuating lever or finger follower and the support member or lash adjuster of a valve actuating mechanism to one another, without increasing a friction in the valve drive. It is also desirable a retention device to provide to effect a free movement of the retention device in all pivoted positions of the finger follower. Thus, there is a need in the art to provide a retention device for a valve actuating mechanism that meets at least one of these desires.

SUMMARY OF THE INVENTION

It is, therefore, one object of the present invention to provide a retention device to secure the finger follower and the lash adjuster of a valve actuating mechanism to one another.

It is another object of the present invention to provide a retention device to secure the finger follower and the lash adjuster of a valve actuating mechanism to one another, without increasing a friction in the valve actuating mechanism.

To achieve one or more of the foregoing objects, the present invention is a retention device for a valve actuating mechanism to secure a finger follower and lash adjuster together. The retention device includes a ring member disposed in a groove of a movable piston of the lash adjuster. The retention device also includes a connecting member having a plurality of legs adapted to engage the finger follower and an intermediate base interconnecting the legs and adapted to be disposed below the ring member and about a portion of the lash adjuster to effect a free movement of the connecting member in all pivoted positions of the finger follower.

One advantage of the present invention is that a new retention device is provided for a valve actuating mechanism. Another advantage of the present invention is that the retention device has a connecting member retained by a ring member placed in a groove of a moveable piston of a supporting component such as a lash adjuster. Yet another advantage of the present invention is that the connecting member is below the ring member with enough distance to effect a free movement of the connecting member in all pivoted positions of an actuating lever such as a finger follower. A further advantage of the present invention is that the retention device ensures that the connecting member abuts firmly on the finger follower in all operating positions of the valve actuating mechanism and, due to the tilting movement of the finger follower, can move freely from its upper to its lower and from its lower to its upper edge in the undercut of the moveable piston of the lash adjuster. Yet a further advantage of the present invention is that the connecting member does not need to be enlarged during each individual valve lift, i.e. the individual components of the connecting member do not execute relative movement among each other that would require additional power.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
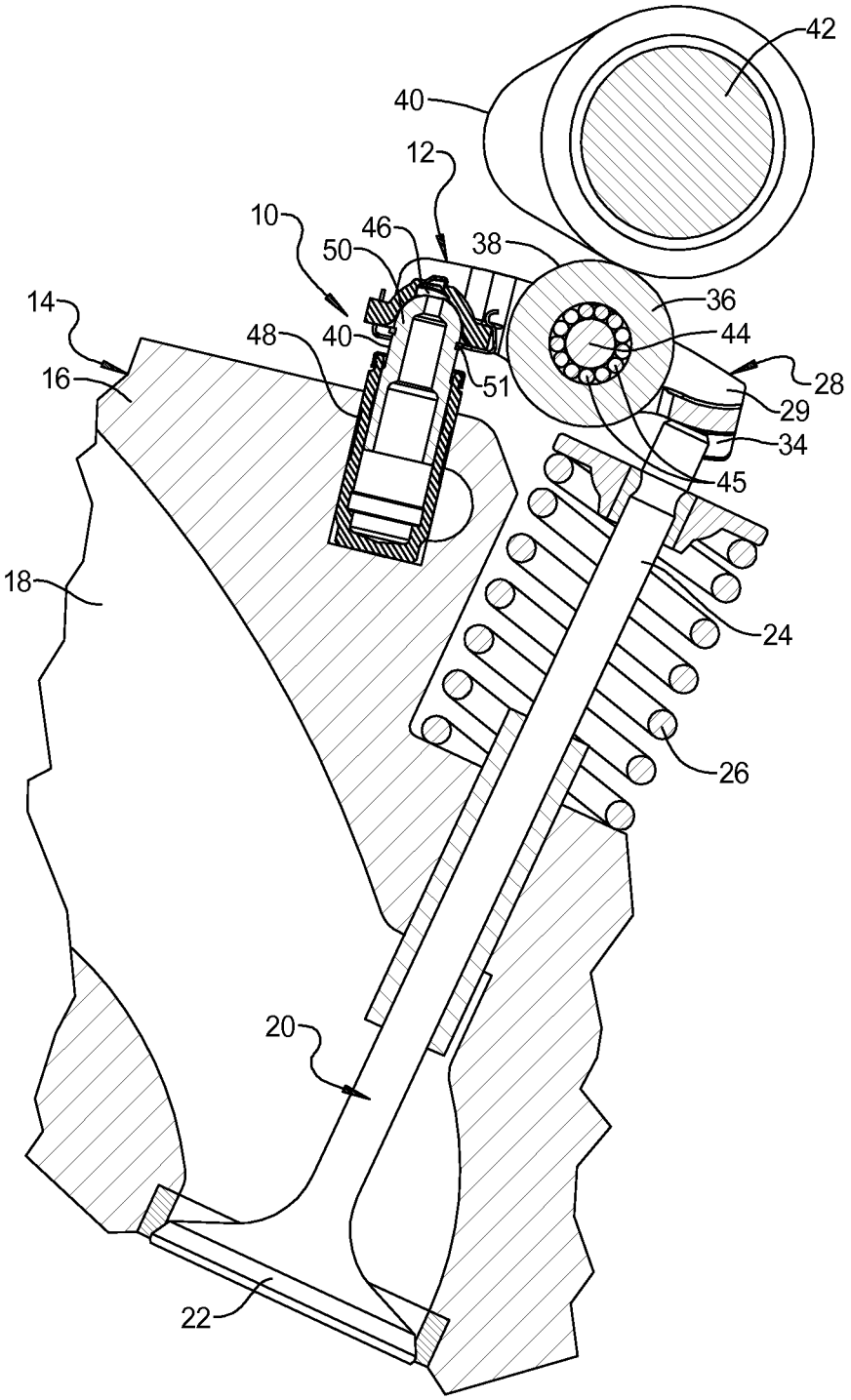
FIG. 1 is a fragmentary view a valve actuating mechanism having a retention device, according to the present invention, illustrated in operational relationship with a portion of an engine.
Figure 2:
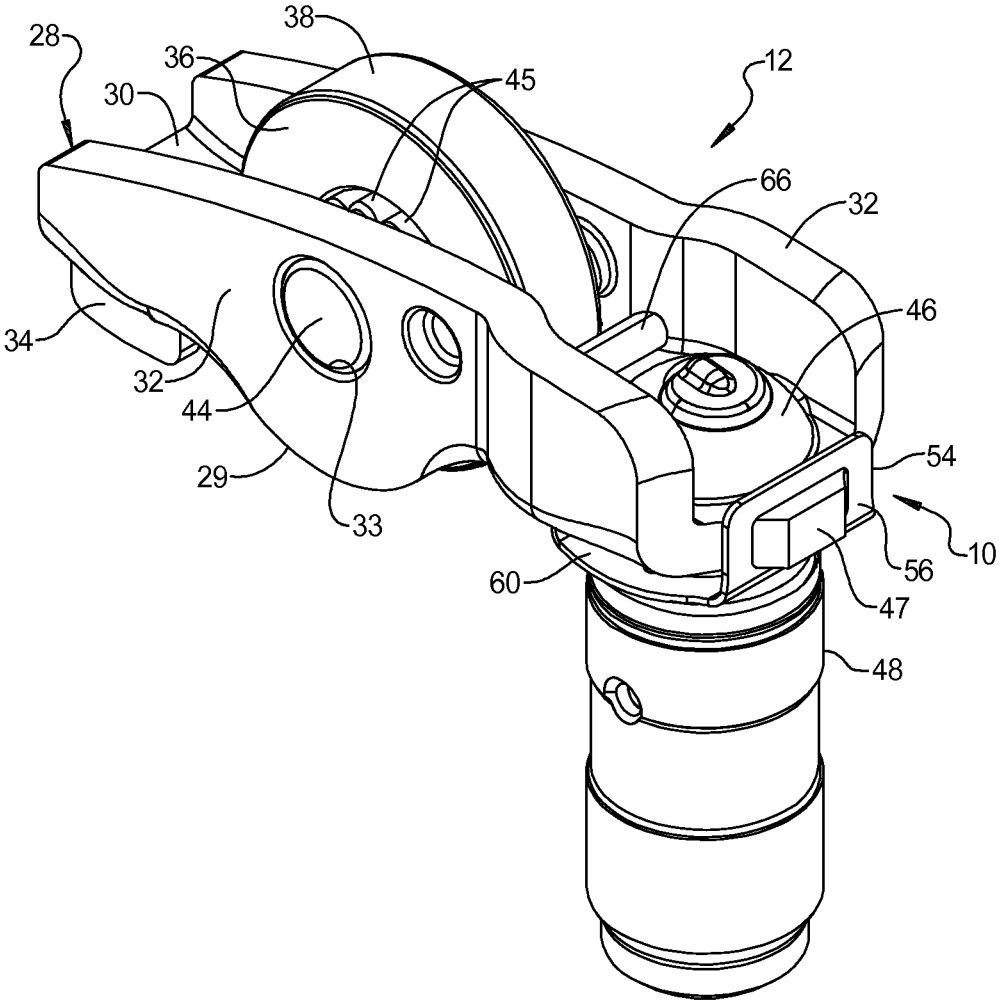
FIG. 2 is a perspective view of the retention device, according to the present invention, of the valve actuating mechanism of FIG. 1.
Figure 4:
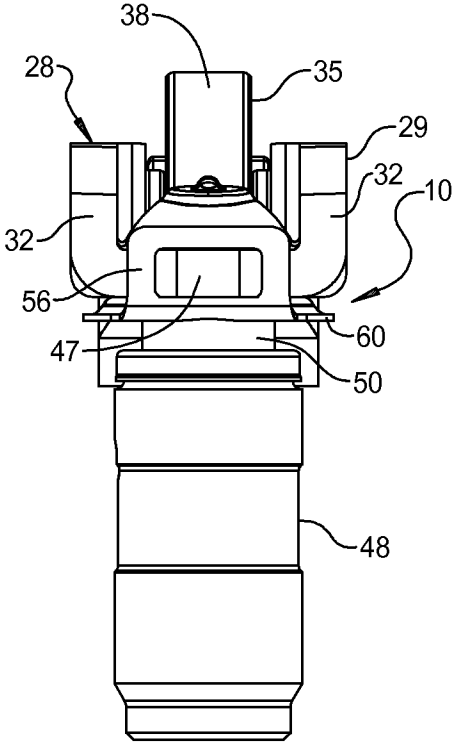
FIG. 4 is a side elevational view of the retention device, according to the present invention, of the valve actuation mechanism of FIG. 1.
Figure 3:
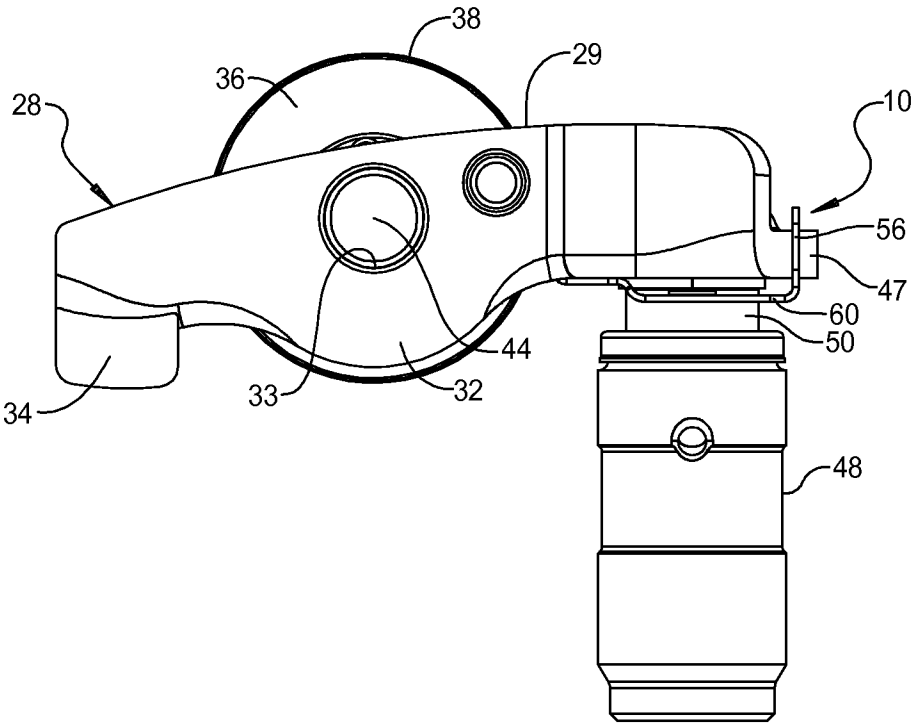
FIG. 3 is a front elevational view of the retention device, according to the present invention, of the valve actuating mechanism of FIG. 1.
Figure 6:
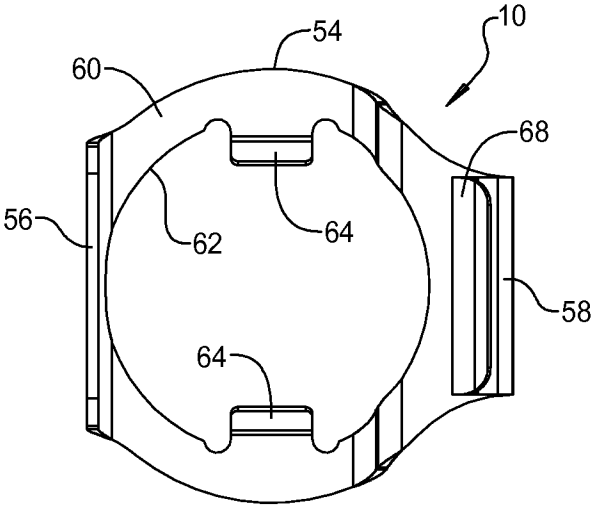
FIG. 6 is a plan view of the retention device, according to the present invention, of FIG. 1.
Figure 8:
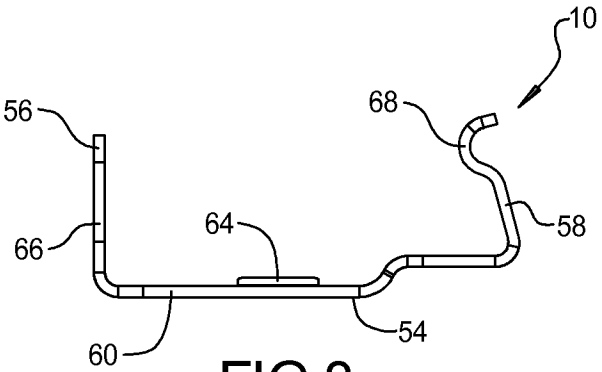
FIG. 8 is a side elevational view of the retention device, according to the present invention, of FIG. 1.
Figure 5:
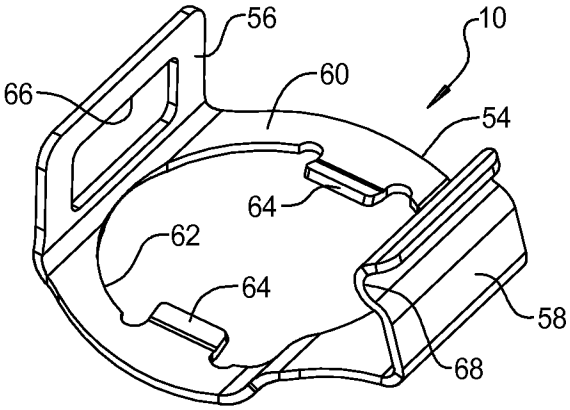
FIG. 5 is a perspective view of the retention device, according to the present invention, of FIG. 1.
Figure 7:
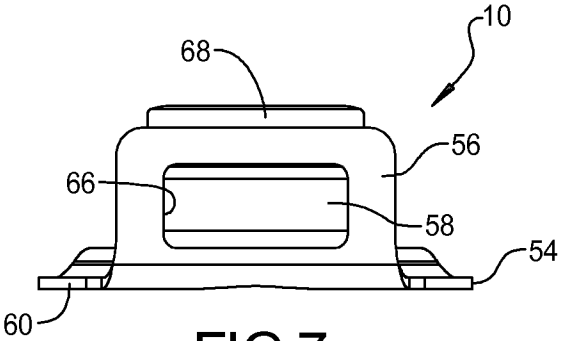
FIG. 7 is a front elevational view of the retention device, according to the present invention, of FIG. 1.
Figure 9:
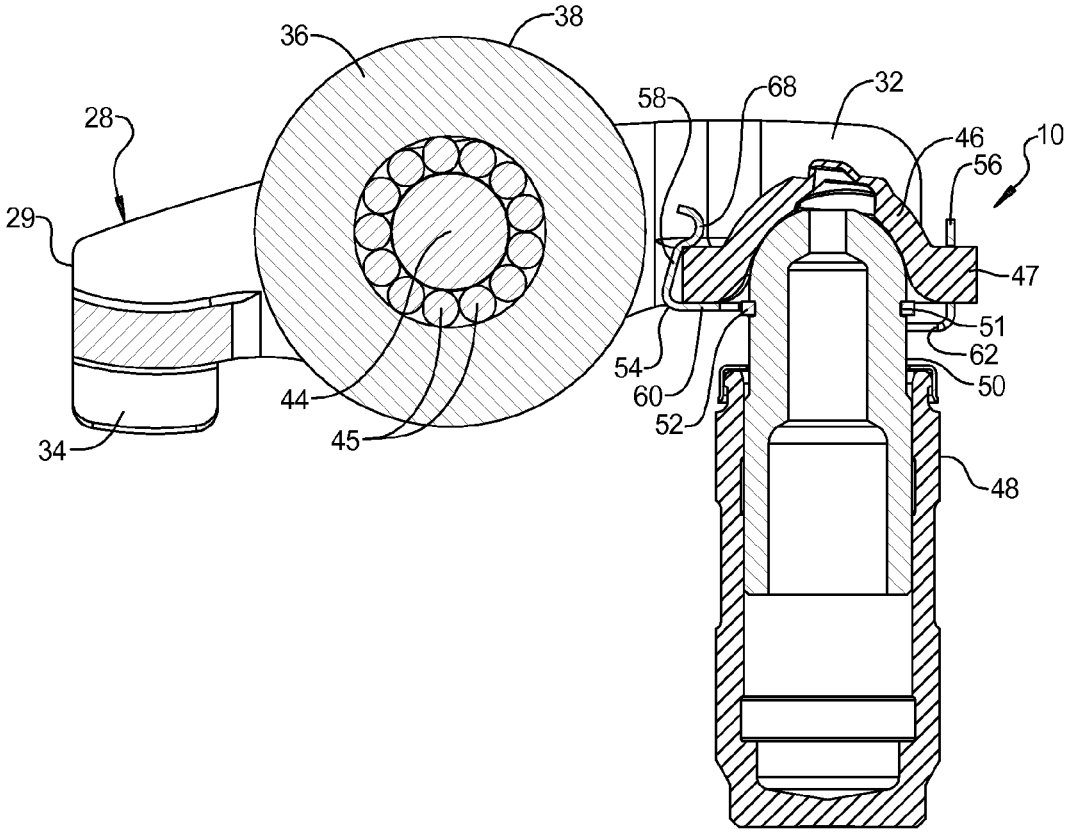
FIG. 9 is a fragmentary front elevational view of the retention device, according to the present invention, of the valve actuation mechanism of FIG. 1.
Figure 17:
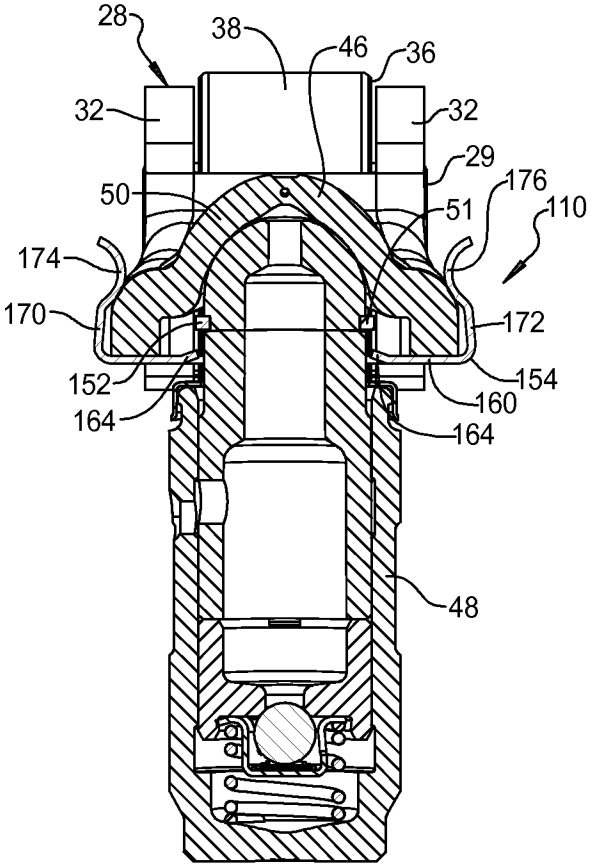
FIG. 17 is a fragmentary side elevational view of the retention device, according to the present invention, of the valve actuation mechanism of FIG. 11.
Figure 10:
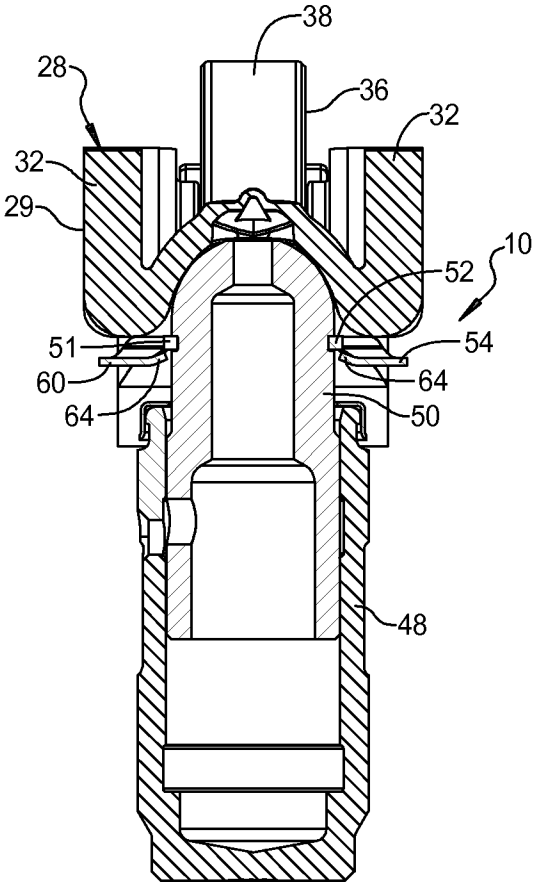
FIG. 10 is a fragmentary side elevational view of the retention device, according to the present invention, of the valve actuation mechanism of FIG. 1.
Figure 11:
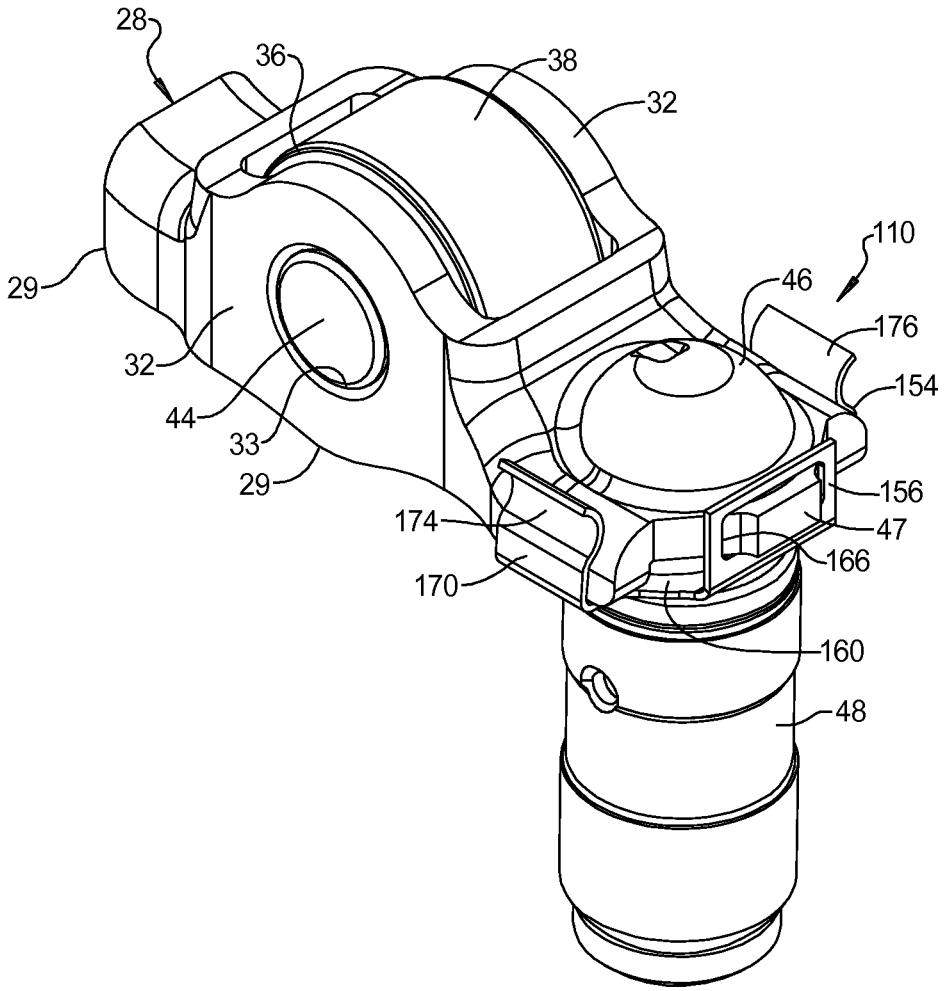
FIG. 11 is a perspective view of another embodiment, according to the present invention, of the retention device of FIG. 1.
Figure 13:
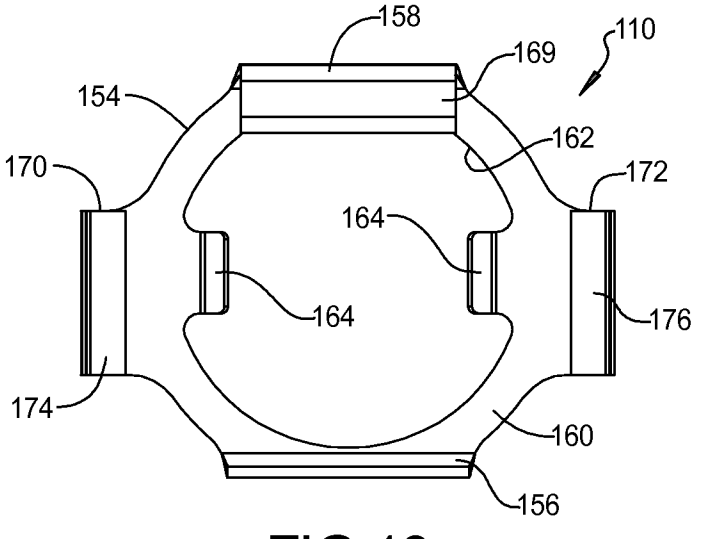
FIG. 13 is a plan view of the retention device, according to the present invention, of FIG. 11.
Figure 15:
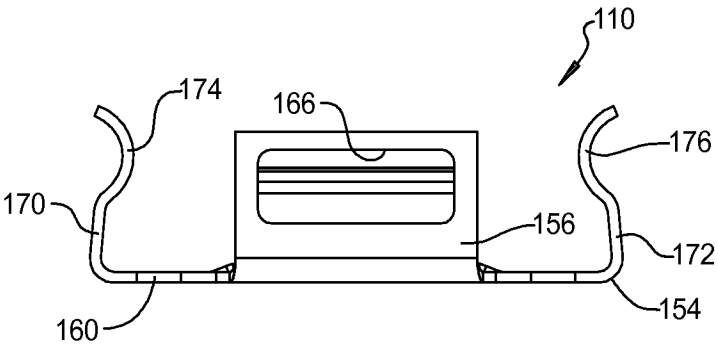
FIG. 15 is a side elevational view of the retention device, according to the present invention, of FIG. 11.
Figure 12:
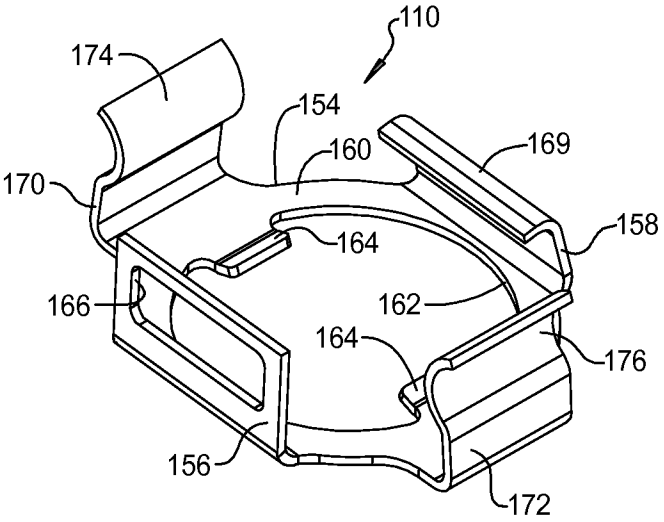
FIG. 12 is a perspective view of the retention device, according to the present invention, of FIG. 11.
Figure 14:
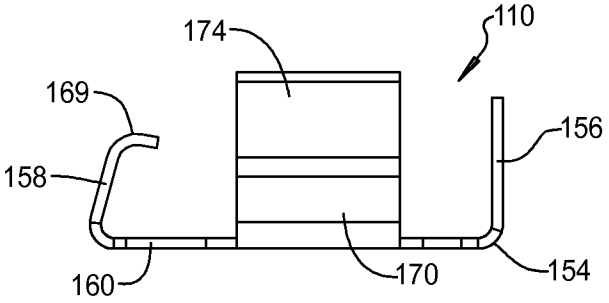
FIG. 14 is a front elevational view of the retention device, according to the present invention, of FIG. 11.
Figure 16:
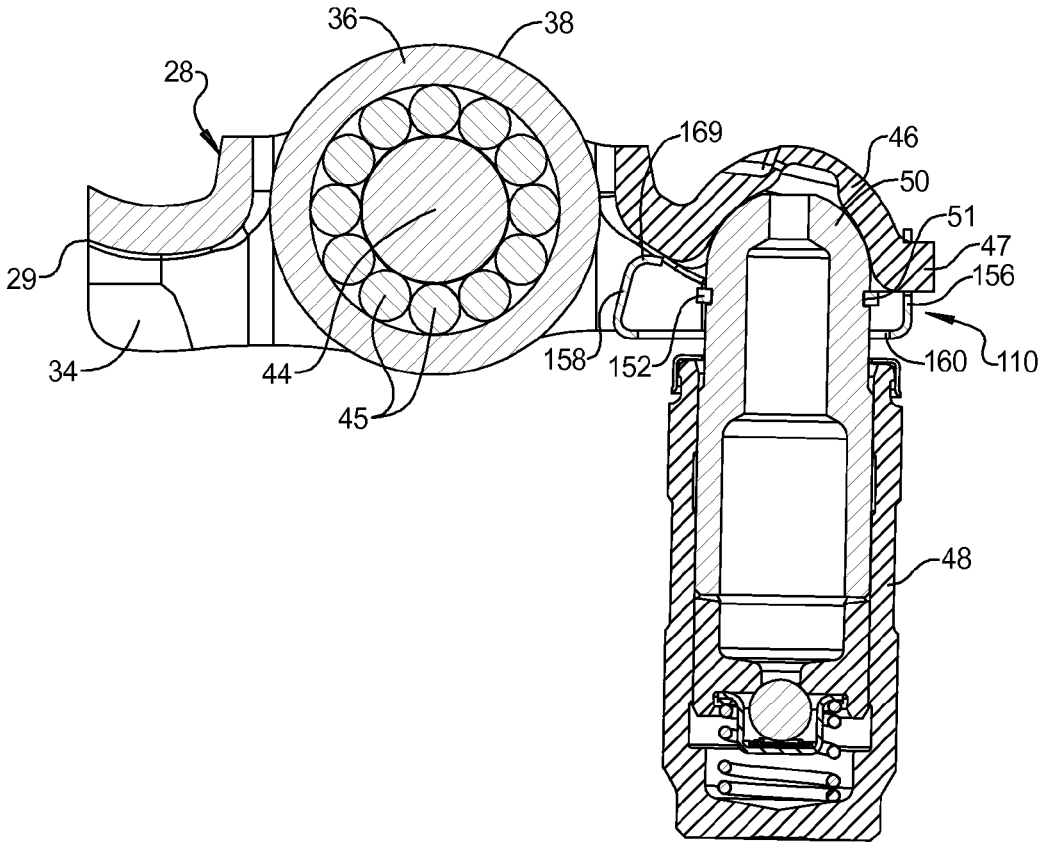
FIG. 16 is a fragmentary front elevational view of the retention device, according to the present invention, of the valve actuation mechanism of FIG. 11.

Referring now to the drawings, and in particular FIG. 1, one embodiment of a retention device 10, according to the present invention, for a valve actuating mechanism, generally indicated at 12, of a finger follower type is shown for an engine, generally indicated at 14. The engine 14 is of an overhead cam type having a cylinder head 16 including an inlet or exhaust port 18. The engine 14 also includes a valve 20 having a head 22 and a stem 24 extending from the head 22. The engine 14 includes a spring 26 disposed about the stem 24 that biases the head 22 of the valve 20 to a closed position. It should be appreciated that the engine 14 is conventional and known in the art.

Referring to FIGS. 1 through 4, the valve actuating mechanism 12 includes an actuating lever or finger follower, generally indicated at 28, having a lever body 29 having a base wall 30 and a pair of opposed side walls 32 extending substantially parallel from the base wall 30 with an aperture 33 extending through each of the side walls 32. The finger follower 28 also includes a pallet or actuating pad 34 at one end of the lever body 29 engaging the stem 24 of the valve 20. The finger follower 28 includes a roller or cam follower 36 disposed between the side walls 32 and having an outer surface 38 engaged by an associated cam 40 of a camshaft 42 of the valve actuating mechanism 12. The roller 36 is generally circular in shape and is rotatably mounted to the side walls 32 by a pin 44 extending through the roller 36 and the apertures 33 in the side walls 32 of the lever body 29. It should be appreciated that the roller 36 has one or more bearing members 45 disposed about the pin 44 to allow the roller 36 to rotate relative to the pin 44.

The finger follower 28 includes a dome socket 46 disposed between the side walls 32 at an end of the lever body 29 opposite the actuating pad 34. The finger follower 28 also has a tab 47 extending outwardly from the end of the lever body 29 adjacent the dome socket 46. The finger follower 28 is made of a metal material and is integral, unitary, and one-piece. It should be appreciated that the dome socket 46 also includes a lubrication spray orifice extending therethrough.

The valve actuating mechanism 10 further includes a support member or hydraulic lash adjuster 48 that is supported by the cylinder head 16. The hydraulic lash adjuster 48 has a movable piston with a rounded end 50 disposed in and engaging the dome socket 46 of the finger follower 28. The rounded end 50 may include a groove 51 extending inwardly radially and circumferentially. It should be appreciated that the dome socket 46 receives lubrication fluid via the lash adjuster 48 and the lubrication fluid is sprayed through the lubrication spray orifice toward the outer surface of the associated roller 36 for lubricating the roller 36 and the associated cam 40, and, by the resulting spray, lubricating the pallet 34 which actuates the valve 20.

Referring to FIGS. 5 through 10, one embodiment of the retention device 10, according to the present invention, is shown. The retention device 10 holds the actuating lever such as the finger follower 28 and the support member such as the lash adjuster 48 together. The retention device 10 includes a ring member 52 disposed in a groove of the moveable piston of the lash adjuster 48. The ring member 52 is generally circular in shape and of a snap ring type. The ring member 52 is made of a metal material. The ring member 52 is disposed in the groove 51 of the movable piston and extends radially outwardly past the exterior surface of the movable piston. It should be appreciated that the ring member 52 could be formed as part of the rounded end 50 of the moveable piston as opposed to being a separate member.

The retention device 10 also includes a connecting member 54 cooperating with the end of the finger follower 28 and retained by the ring member 52. The connecting member 54 is generally U-shaped and has first and second legs 56 and 58, respectively, interconnected by an intermediate base 60. The intermediate base 60 is generally circular in shape and flat or planar. The intermediate base 60 has an aperture 62 extending therethrough. The aperture 62 is generally circular in shape. The intermediate base 60 includes a plurality of, preferably two tabs 64 extending from the sides of the aperture 62 and opposing each other. The tabs 64 are generally rectangular in shape and extend upwardly at an angle. It should be appreciated that the tabs 64 are formed to be angled up to aid the retention of the connecting member 54 to the ring member 52 disposed in the groove 51 of the movable piston of the lash adjuster 48. It should also be appreciated that the rest of the intermediate base 60 has no protrusions or tabs, thus allowing the free movement of the connecting member 54 in all pivoted positions of the finger follower 28.

The first and second legs 56 and 58 forming the U-shape extend approximately 90° from the intermediate base 60. The first leg 56 is generally rectangular in shape and has an aperture 66 extending therethrough. The aperture 66 is generally rectangular in shape and encompasses the tab 47 formed at the end of the finger follower 28. The second leg 58 is generally rectangular in shape and formed with a lobe section 68 at the top, to snap into place to the finger follower 28 on the opposing side of dome socket 46 from the tab 47 that the first leg 56 encompasses. The lobe section 68 is generally arcuate in shape and extends inwardly. The connecting member 54 is made of a metal material. It should be appreciated that the connecting member 54 is integral, unitary, and one-piece.

To assemble the retention device 10 in the valve actuation mechanism 12, the ring member 52 is disposed or snapped into the groove 51 of the movable piston of the lash adjuster 48. The connecting element 54 has the intermediate base 60 disposed below the ring member 52 with enough distance to effect a free movement of the connecting member 54 in all pivoted positions of the finger follower 28. The tabs 64 engage the ring member 52 and ensure that the connecting member 54 firmly bears on the lever body 29 of the finger follower 28 in all operating positions of the valve actuating mechanism 12 and, due to the tilting movement of the finger follower 28, can move freely from its upper to its lower and from its lower to its upper edge in the undercut of the moveable piston. The first leg 56 is disposed over the tab 47 of the end of the finger follower 28 such that the tab 47 extends through the aperture 66. The second leg 58 is connected to the finger follower 28 such that the lobe section 68 is disposed in a corresponding groove of the finger follower 28.

In operation of the valve actuating mechanism 12, the camshaft 42 of the engine 14 rotates and the cam 40 of the camshaft 42 actuates the finger follower 28. The lash adjuster 48 acts as a pivot about which the finger follower 28 is actuated to open and close an associated valve 20 of the engine 14. Lubrication fluid from the lash adjuster 48 is provided to the dome socket 46 through the opening or orifice in the rounded end 50 of the lash adjuster 48. The lubrication fluid in the dome socket 46 is sprayed through the orifice into the camshaft compartment for lubricating the cam 40 and roller 36 and associated components of the valve actuating mechanism 12. It should be appreciated that the connecting member 54 does not need to be enlarged during each individual valve lift, i.e. the individual components of the connecting member 54 do not execute relative movement among each other that would require additional power. It should also be appreciated that, in this manner, the connecting member 54 is ensured to bear firmly against the finger follower 28 in all operating positions of the valve actuating mechanism 12 while at the same time is permitted to move, as a result of the pivoting motion of the finger follower 28.

Referring to FIGS. 11 through 17, another embodiment, according to the present invention, of the retention device 10 is shown for the valve actuating mechanism 12 Like parts of the retention device 10 have like reference numerals increased by one hundred (100). The retention device 110 holds the finger follower 28 and the lash adjuster 48 together. In this embodiment, the retention device 110 includes a ring member 152 disposed in the groove 51 of the moveable piston of the lash adjuster 48. The ring member 152 is generally circular in shape and of a snap ring type. The ring member 152 is made of a metal material. It should be appreciated that the ring member 152 could be formed as part of the rounded end 50 of the moveable piston as opposed to being a separate member.

The retention device 110 also includes a connecting member 154 cooperating with the end of the finger follower 28 and retained by the ring member 152. In this embodiment, the connecting member 154 is generally U-shaped and has first and second legs 156 and 158, respectively, and third and fourth legs 170 and 172, respectively, interconnected by an intermediate base 160. The intermediate base 160 is generally circular in shape and flat or planar. The intermediate base 160 has an aperture 162 extending therethrough. The aperture 162 is generally circular in shape. The intermediate base 160 includes a plurality of, preferably two tabs 164 extending from the sides of the aperture 160 and opposing each other. The tabs 164 are generally rectangular in shape and extending upwardly at an angle. It should be appreciated that the tabs 164 are formed to be angled up to aid the retention of the connecting member 154 to the ring member 152 disposed in the groove 51 of the movable piston of the lash adjuster 48. It should also be appreciated that the rest of the intermediate base 160 has no protrusions or tabs, thus allowing the free movement of the connecting member 154 in all pivoted positions of the finger follower 28.

The first and second legs 156 and 158 forming the U-shape are approximately 90° from the intermediate base 160. The first leg 156 is generally rectangular in shape and has an aperture 166 extending therethrough. The aperture 166 is generally rectangular in shape and encompasses the tab 47 formed at the end of the finger follower 28. The second leg 158 is generally rectangular in shape and formed with an angled section 169 extending inwardly at the top, to snap into place to the finger follower 28 on the opposing side of dome socket 46 from the tab 47 that the first leg 156 encompasses. The third and fourth legs 170 and 172 forming the U-shape are approximately 90° from the intermediate base 160. The third leg 170 is generally rectangular in shape and formed with a lobe section 174 at the top, to snap into place to the finger follower 28 on one of the other opposing sides of dome socket 46. The lobe section 174 is generally arcuate in shape and extends inwardly. The fourth leg 172 is generally rectangular in shape and formed with a lobe section 176 at the top, to snap into place to the finger follower 28 on the opposing side of dome socket 46 from the third leg 170. The lobe section 176 is generally arcuate in shape and extends inwardly. The connecting member 154 is made of a metal material. It should be appreciated that the connecting member 154 is integral, unitary, and one-piece.

To assemble the retention device 110 to the valve actuating mechanism 12, the ring member 152 is disposed or snapped into the groove 51 of the movable piston of the lash adjuster 48. The connecting member 154 has the intermediate base 160 disposed below the ring member 152 with enough distance to effect a free movement of the connecting member 154 in all pivoted positions of the finger follower 28. The tabs 164 engage the ring member 152 and ensure that the connecting member 154 firmly bears on the lever body 29 of the finger follower 28 in all operating positions of the valve train and, due to the tilting movement of the operating lever, can move freely from its upper to its lower and from its lower to its upper edge in the undercut of the moveable piston. The first leg 156 is disposed over the tab 47 of the end of the finger follower 28 such that the tab 47 extends through the aperture 166. The second leg 158 is connected to the finger follower 28 such that the angled section 169 is disposed in a corresponding groove of the finger follower 28. The third and fourth legs 170 and 172 are connected to the finger follower 28 such that the lobe sections 174 and 176, respectively, are disposed over a portion of the lever body 29. The operation of the retention device 110 is similar to the retention device 10.

The retention device 10, 110 of the present invention has a connecting member 54, 154 retained by a ring member 52, 152 placed in a groove 51 of a moveable piston of a supporting component such as a lash adjuster 48. The connecting member 54, 154 of the present invention is disposed below the ring member 52, 152 with enough distance to effect a free movement of the connecting member 54, 154 in all pivoted positions of the finger follower 28. This ensures that the connecting member 54, 154 of the present invention abuts firmly on the lever body 29 of the finger follower 28 in all operating positions of the valve actuating mechanism 12 and, due to the tilting movement of the finger follower 28, can move freely from its upper to its lower and from its lower to its upper edge in the undercut of the moveable piston of the lash adjuster 38. Thus the connecting member 54, 154 of the present invention does not need to be enlarged during each individual valve lift, i.e. the individual components of the connecting member 54, 154 do not execute relative movement among each other that would require additional power.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A retention device to secure a finger follower to a lash adjuster, said retention device comprising:

a ring member disposed in a groove of a moveable piston of the lash adjuster; and a connecting member having an intermediate base and a plurality of legs extending from said intermediate base in a first direction, said legs adapted to engage the finger follower, said intermediate base interconnecting said legs and adapted to be disposed below said ring member and about a portion of the lash adjuster to effect a free movement of said connecting member in all pivoted positions of the finger follower; and wherein said intermediate base includes an aperture formed therein and extending therethrough with a plurality of tabs extending from said intermediate base at least partially radially inward relative to said aperture towards each other and at least partially in said first direction to engage said ring member.

2. A retention device as set forth in claim 1 wherein said intermediate base and said aperture are generally circular in shape.

3. A retention device as set forth in claim 1 wherein said tabs comprise a pair of opposed tabs extending from said aperture at an angle with respect to said intermediate base.

4. A retention device as set forth in claim 1 wherein said legs comprise a first leg extending generally perpendicularly from said intermediate base and a second leg opposing said first leg and extending generally perpendicularly from said intermediate base.

5. A retention device as set forth in claim 4 wherein said first leg has an aperture extending therethrough adapted to receive a tab of the finger follower, with said aperture of said first leg being disposed in spaced relation to said aperture of said intermediate base.

6. A retention device as set forth in claim 4 wherein said second leg has a lobe section extending inwardly adapted to be disposed in a groove of the finger follower.

7. A retention device as set forth in claim 4 wherein said legs include a third leg extending generally perpendicularly from said intermediate base and a fourth leg opposing said third leg and extending generally perpendicularly from said intermediate base.

8. A retention device as set forth in claim 7 wherein said third leg and said fourth leg each include a lobe section extending inwardly adapted to be disposed over a portion of the finger follower.

9. A retention device as set forth in claim 1 wherein said connecting member is integral, unitary, and one-piece.

10. A retention device as set forth in claim 1 wherein said ring member is a snap ring.

11. A retention device as set forth in claim 1 wherein said tabs are interposed radially between said legs about said aperture.

12. A valve actuating mechanism for an engine comprising:

a finger follower having one end adapted to engage a valve of the engine;

a lash adjuster adapted to be supported by the engine, said lash adjuster having a movable piston with a rounded end and a groove in said rounded end; and a retention device to secure said finger follower and said lash adjuster together and comprising a ring member disposed in said groove of said moveable piston and a connecting member having an intermediate base and a plurality of legs extending from said intermediate base in a first direction and engaging said finger follower, said intermediate base interconnecting said legs and disposed below said ring member and about said rounded end of said lash adjuster to effect a free movement of said connecting member in all pivoted positions of said finger follower; and wherein said intermediate base of said connecting member includes an aperture formed therein and extending therethrough with a plurality of tabs extending from said intermediate base at least partially radially inward relative to said aperture towards each other and at least partially in said first direction to engage said ring member.

13. A valve actuating mechanism as set forth in claim 12 wherein said legs comprise a first leg extending generally perpendicularly from said intermediate base and a second leg opposing said first leg and extending generally perpendicularly from said intermediate base.

14. A valve actuating mechanism as set forth in claim 13 wherein said first leg has an aperture extending therethrough to receive a tab of said finger follower, with said aperture of said first leg being disposed in spaced relation to said aperture of said intermediate base.

15. A valve actuating mechanism as set forth in claim 13 wherein said second leg has a lobe section extending inwardly and disposed in a groove of said finger follower.

16. A valve actuating mechanism as set forth in claim 13 wherein said legs include a third leg extending generally perpendicularly from said intermediate base and a fourth leg opposing said third leg and extending generally perpendicularly from said intermediate base.

17. A valve actuating mechanism as set forth in claim 16 wherein said third leg and said fourth leg each include a lobe section extending inwardly adapted to be disposed over a portion of said finger follower.

18. A valve actuating mechanism as set forth in claim 12 wherein said tabs are interposed radially between said legs about said aperture.

* * * * *